US009349505B2

(12) United States Patent
Tozawa et al.

(10) Patent No.: US 9,349,505 B2
(45) Date of Patent: May 24, 2016

(54) ELECTRIC CABLE

(71) Applicant: SUMITOMO ELECTRIC INDUSTRIES, LTD., Osaka-shi, Osaka (JP)

(72) Inventors: Masahiro Tozawa, Kanuma (JP); Taro Fujita, Osaka (JP); Atsuko Shinomiya, Kanuma (JP)

(73) Assignee: SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 14/373,905

(22) PCT Filed: Dec. 17, 2013

(86) PCT No.: PCT/JP2013/083803

§ 371 (c)(1),
(2) Date: Jul. 23, 2014

(87) PCT Pub. No.: WO2014/098100

PCT Pub. Date: Jun. 26, 2014

(65) Prior Publication Data

US 2014/0367141 A1 Dec. 18, 2014

(30) Foreign Application Priority Data

Dec. 18, 2012 (JP) ..... 2012-275533

(51) Int. Cl.
*H01B 5/08* (2006.01)
*H01B 7/295* (2006.01)
(Continued)

(52) U.S. Cl.
CPC ..... *H01B 7/295* (2013.01); *H01B 3/441* (2013.01); *H01B 3/447* (2013.01); *H01B 3/448* (2013.01); *H01B 7/17* (2013.01); *H01B 7/0275* (2013.01); *H01B 7/04* (2013.01)

(58) Field of Classification Search
CPC ..... H01B 5/08
USPC ..... 174/128.2, 121 A, 128.1, 110 R
See application file for complete search history.

(56) References Cited

U.S. PATENT DOCUMENTS 6,140,589 A * 10/2000 Blackmore ..... 174/128.1
2003/0111256 A1* 6/2003 Fujiwara ..... H01B 1/023 174/128.1

(Continued)

FOREIGN PATENT DOCUMENTS

CN 1566189 A 1/2005
JP H09-59392 A 3/1997

(Continued)

OTHER PUBLICATIONS

Notification of First Office Action issued Oct. 27, 2015 is Chinese Patent Application No. 201380004650.7 (7 pages) with an English Translation (9 pages).

*Primary Examiner* — Chau N Nguyen
(74) *Attorney, Agent, or Firm* — Drinker Biddle & Reath LLP

(57) ABSTRACT

An electric cable for improving flexibility of an insulating resin portion of the electric cable expressed by a secant modulus value is provided. In an electric cable 10*a* in which an outer periphery of a conductor 11 made of wires with diameters from 0.15 to 0.5 mm and having a cross-sectional area of 20 $mm^2$ or more is covered with an insulating resin 12 including a flame retardant, a ratio of an electric cable diameter to a conductor diameter is from 1.15 to 1.40, and a secant modulus of the insulating resin 12 is from 10 to 50 MPa.

5 Claims, 2 Drawing Sheets

(51) Int. Cl.

| | |
|---|---|
| ***H01B 7/17*** | (2006.01) |
| ***H01B 3/44*** | (2006.01) |
| *H01B 7/04* | (2006.01) |
| *H01B 7/02* | (2006.01) |

(56) References Cited

U.S. PATENT DOCUMENTS

| | | | | |
|---|---|---|---|---|
| 2009/0301751 | A1* | 12/2009 | Iwasaki | C08F 8/00 174/100 SR |
| 2012/0217035 | A1 | 8/2012 | Iwasaki et al. | |

FOREIGN PATENT DOCUMENTS

| | | | | |
|---|---|---|---|---|
| JP | H09-59413 | A | | 3/1997 |
| JP | 2003-297153 | | * | 10/2003 |
| JP | 2004-352889 | A | | 12/2004 |
| JP | 2009-127040 | A | | 6/2009 |
| JP | 2010-176961 | A | | 8/2010 |
| JP | 2012-174645 | A | | 9/2012 |
| JP | 2012-241041 | A | | 12/2012 |
| WO | WO-2012/124589 | A1 | | 9/2012 |

* cited by examiner

ELECTRIC CABLE

TECHNICAL FIELD

The present invention relates to an electric cable used in wiring etc. of the inside of an electric device or a vehicle.

BACKGROUND ART

An electric cable used in wiring etc. of the inside of an electric device or a vehicle requires ease of wiring work (routing) inside small space and a saving in space by decreasing a bending radius, and a cable with great flexibility is demanded. For example, Patent Reference 1 discloses a halogen-free insulated electric wire for a vehicle having abrasion resistance, flame resistance and flexibility using a polyolefin resin as a base resin.

PRIOR ART REFERENCE

Patent Reference

Patent Reference 1
JP-2009-127040-A

SUMMARY OF THE INVENTION

Problems that the Invention is to Solve

The flexibility of an electric cable depends on a bending rigidity of the electric cable. The bending rigidity of the electric cable is set by the sum of bending rigidities of a conductor portion and an insulator portion of the cable. The respective bending rigidities are expressed by the product of a Young's modulus E of a cable constituting member and a second moment of area (a moment of inertia) of the cable constituting member. In the electric cable of a power source system inside a vehicle, the capacity of the insulator portion is larger than the capacity of the conductor portion and a bending strain of the outside insulator becomes larger than that of the conductor. As a result, the bending rigidity of the electric cable is larger influenced by the bending rigidity by the insulator portion than the bending rigidity by the conductor portion.

For example, Patent Reference 1 discloses a method of preparing a specimen by molding a covering material into a plate shape with predetermined dimensions, fixing the specimen to a fixed base such that the specimen projects from the fixed based by 60 mm, and applying a weight of 20 g onto the specimen at a position of 10 mm from the projecting tip thereof, thereby discriminating the cable having been bent by 15 mm or more as being the flexible cable. However, it may not be general. As there may be no unified standards for the flexibility of the electric cable, the definition of the flexibility is ambiguous.

The invention is made in view of the above-mentioned circumstances, and an object of the invention is to express flexibility of an insulating resin portion of an electric cable by a secant modulus value and to provide an electric cable with an improved flexibility.

Means for Solving the Problems

The invention provides an electric cable, including: a conductor being made of wires a diameter of each of which is from 0.15 to 0.5 mm and having a cross-sectional area of 20 $mm^2$ or more; and an insulating resin including a flame retardant and covering an outer periphery of the conductor, wherein a ratio of a diameter of the electric cable to a diameter of the conductor is from 1.15 to 1.40, and wherein a secant modulus of the insulating resin is from 10 to 50 MPa.

The invention also provides an electric cable, including: a conductor having a cross-sectional area of 20 mm2 or more; and an insulating resin including a flame retardant and covering the conductor; a shielding conductor covering an outer periphery of the insulating resin; and an insulating resin covering n outer periphery of the shielding conductor, wherein a ratio of a diameter of the electric cable to a diameter of the conductor is from 1.40 to 1.77, and wherein a secant modulus of at least one of the insulating resin inside the shielding conductor and the insulating resin outside the shielding conductor is from 10 to 50 MPa.

The insulating resin inside the shielding conductor and the insulating resin outside the shielding conductor may be made of a same resin. The insulating resin with the secant modulus of 10 to 50 MPa may be a copolymer A consisting of a comonomer having polarity and olefin, or a mixture of the copolymer A and a copolymer B consisting of α-olefin and olefin. Alternatively, it may be an olefin resin including a comonomer having polarity, and an amount of the comonomer is 23% or more by weight. And, the insulating resin may be cross-linked.

Advantage of the Invention

The electric cable of the invention can ensure unprecedented flexibility, and facilitates wiring work (routing) inside small space, and can achieve a saving in space by, for example, decreasing a bending radius.

MODE FOR CARRYING OUT THE INVENTION

Figure 1A:
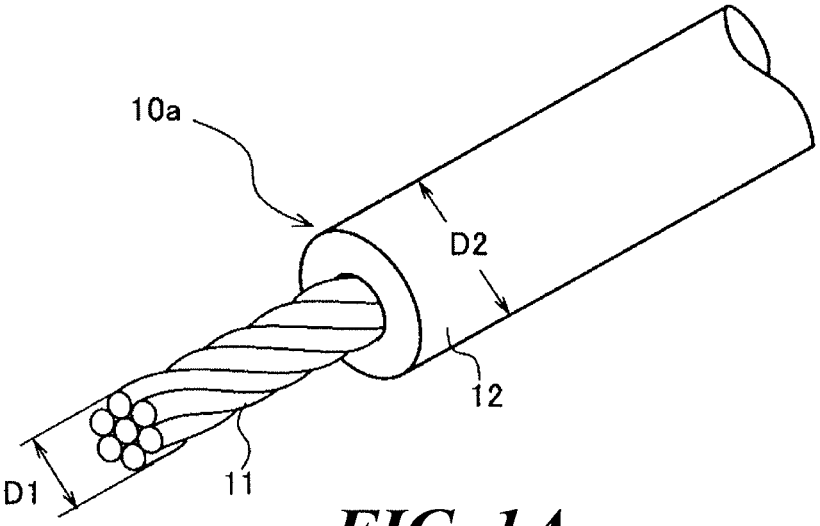
[FIG. 1] A diagram schematically showing an electric cable according to the invention.
Figure 1B:
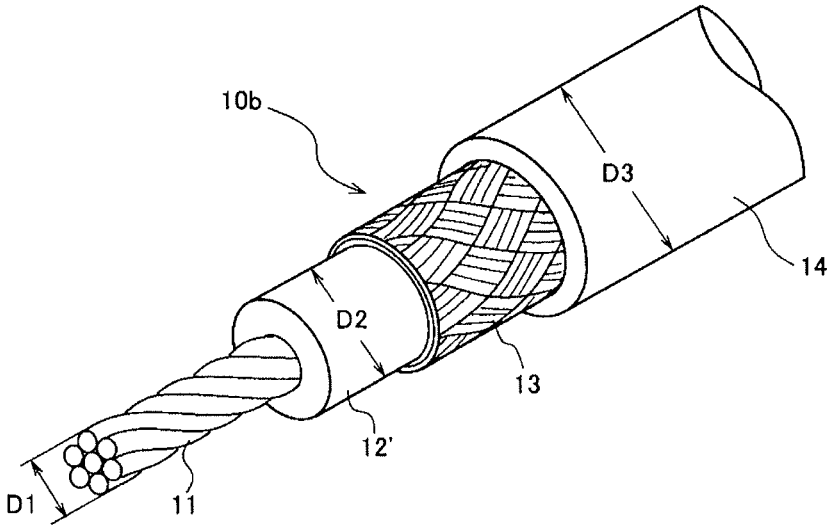

An electric cable according to the invention will hereinafter be schematically described with reference to the drawings. FIG. 1A shows an example of an insulated electric wire in which a conductor is insulated using an insulator. FIG. 1B shows an example of a shielded electric wire in which a shielding conductor is provided on an outer periphery of the insulated electric wire shown in FIG. 1A. In FIGS. 1A and 1B, numeral 10*a* shows an insulated electric wire, and numeral 10*b* shows a shielded electric wire, numeral 11 shows a central conductor, numerals 12, 12' show insulators, numeral 13 shows a shielding conductor, and numeral 14 shows a sheath.

For example, the electric cable according to the invention is used in wiring of a power source system of a motor, an inverter, etc. inside a hybrid vehicle or an electric vehicle.

The electric cable shown in FIG. 1A is the insulated electric wire 10*a*. In the insulated electric wire 10*a*, the central conductor (conductor) 11 has a cross-sectional area of 20 SQ (20 $mm^2$) or more, and the insulator 12 uses a polyolefin resin as a base resin.

The electric cable shown in FIG. 1B is the shielded electric wire 10*b*. In the shielded electric wire 10*b*, the shielding conductor 13 is provided on an outer periphery of the insulator 12', which is of the insulated electric wire 10*a* of FIG. 1A, and the sheath (outer sheath) 14 covers the shielding conductor 13. The shielding conductor 13 is formed by braiding or lateral wrapping.

The conductor 11 may be a single wire or a twisted wire formed by braiding plural strands, and may be made of general conductive material, such as copper, annealed copper, silver, nickel-plated annealed copper, tin-plated annealed copper. In the case of the twisted wire, a diameter of each strand may be about 0.18 to 0.5 mm.

The electric cable according to the invention is directed to a cable in which a ratio (D2/D1) of an insulator outside diameter D2 to a conductor outside diameter D1 is in the range of 1.15 to 1.40 or a ratio (D3/D1) of a sheath outside diameter D3 to a conductor outside diameter D1 is in the range of 1.40 to 1.77 where the outside diameter of the conductor 11 is D1, where the outside diameters of the insulators 12, 12' are D2, and where the outside diameter of the sheath 14 is D3.

The polyolefin resin, as the base resin of the insulator 12, is for example, low-density polyethylene (LDPE), linear low-density polyethylene (L-LDPE), and copolymers such as an ethylene-ethyl acrylate copolymer (EEA), an ethylene-methyl acrylate copolymer (EMA) or an ethylene-vinyl acetate copolymer (EVA) in which a monomer having other polarity other than α-olefin is introduced in order to provide the resin with flexibility. As described below, an additive agent such as a flame retardant, an antioxidant or a cross-linking agent is added to the base resin and the insulator 12 is extruded and molded on the outer periphery of the conductor 11.

The insulator 12 covers the outer periphery of the conductor 11 with a uniform thickness by extrusion molding etc. to realize electrical insulation. The insulator 12, as the insulating covering, is cross-linked by chemical cross-linking such as silane cross-linking, peroxide cross-linking or application of ionizing radiation (γ rays, an electron beam, etc.) after covering the outer surface of the conductor in order to improve heat deformation resistance, so that electrical insulation property is not deteriorated due to deformation even when an external force is applied in a relatively high temperature environment. It is unnecessary to cross-link the electric cable of the invention, but it is preferable to cross-link the electric cable since the cross-linking improves tensile strength and heat resistance. The cross-linking increases a secant modulus described below by several % to several tens %.

In the shielded electric wire 10*b*, one of the insulator 12' and the sheath 14 is a resin equal to the insulator 12. Both of the insulator 12' and the sheath 14 may be a resin equal to the insulator 12. The insulator 12' and the sheath 14 are extruded and molded like the insulator 12. After extruded and molded, cross-linking treatment may be performed.

In the relatively large-diameter electric cable described above, the invention provides flexibility by setting a secant modulus of an insulator portion of at least one of the insulators 12, 12' and the sheath 14 from 10 MPa to 50 MPa. Accordingly, even for an electric cable with a large conductor size, the electric cable can have flexibility and routing workability. The reason why the secant modulus is herein set at 10 MPa or more is because when the secant modulus is less than this value, in the case of extruding and then taking up the electric cable, the electric cable is deformed and does not have a predetermined outside diameter and the outside diameter becomes unstable.

As the insulators 12, 12', particularly, EEA in the polyolefin resins used in the base resin is preferably used. In the EEA, ethyl acrylate (EA) included in this EEA decreases crystallinity to obtain great flexibility suitable for the present use and also, the thermal decomposition start temperature of the EEA is high (300° C.) and long-term aging heat resistance is high in the polyolefin resins and the EEA is preferable in long-term use as the electric cable which generates heat at the time of energization. Since it is easy to form a char layer at the time of combustion and the char layer blocks oxygen and inhibits combustion, it is easy to achieve high flame resistance with low specific gravity by decreasing the additive amount of a flame retardant. A copolymer content is preferably set at 23% or more by weight, and when the copolymer content is less than this value (23% by weight), crystallinity is high and flexibility decreases. The insulator may be a copolymer consisting of a comonomer having polarity and olefin, or a mixture of this copolymer and a copolymer consisting of α-olefin and olefin.

Table 1 illustrates a relation between a secant modulus and a resin material of the insulator 12, 12' or the sheath 14 used in the electric cable, and shows all example of electron beam cross-linking. For example, in Composition Example 1, EVA with a comonomer content of 33% by weight is used as a base resin, and 55 to 110 parts of an additive agent by weight is added to 100 parts of this EVA by weight. This additive agent includes, for example, 55 parts of a flame retardant by weight, 25 parts of an antioxidant by weight, 1.5 parts of a lubricant by weight and 3 parts of a cross-linking auxiliary agent by weight. For example, in Composition Example 5, a mixture of EP rubber and EVA with a comonomer content of 19% by weight is used as a base resin, and an additive agent including 55 parts of a flame retardant by weight, 25 parts of an antioxidant by weight, 1.5 parts of a lubricant by weight and 3 parts of a cross-linking auxiliary agent by weight is added to the base resin with 40 parts of the EVA by weight and 60 parts of the EP rubber by weight. In Composition Examples 1 to 8, insulating materials with secant moduli of 5 to 81 MPa are obtained.

As shown in Table 1, generally, as the comonomer content increases, the resin material becomes softer and the secant modulus becomes smaller. For example, in Composition Example 8, EVA with a comonomer content of 41% by weight is used as a base resin, and an additive agent including 55 parts of a flame retardant by weight, 25 parts of an antioxidant by weight, 1.5 parts of a lubricant by weight and 3 parts of a cross-linking auxiliary agent by weight is added to 100 parts of this EVA by weight, and the secant modulus becomes 5 MPa. However, since the resin material of Composition Example 8 cannot manufacture an outside diameter of an insulating covering stably, Composition Example 8 is an improper example before evaluation is made using the resin material in the electric cable. As described above, it is necessary that the secant modulus should be 10 MPa or more so that the outside diameter does not become unstable at the time of extruding and forming a covering.

TABLE 1

| Composition | Composition Example 1 | Composition Example 2 | Composition Example 3 | Composition Example 4 | Composition Example 5 | Composition Example 6 | Composition Example 7 | Composition Example 8 |
|---|---|---|---|---|---|---|---|---|
| EVA (Comonomer Content of 33 wt %) | 100 | | | | | | | |
| EMA (Comonomer Content of 25 wt %) | | 100 | | | | | | |
| EEA (Comonomer Content of 23 wt %) | | | 100 | | | | | |
| EVA (Comonomer Content of 25 wt %) | | | | 100 | | | | |
| EVA (Comonomer Content of 19 wt %) | | | | | 40 | | 100 | |
| EEA (Comonomer Content of 15 wt %) | | | | | | 30 | | |
| EVA (Comonomer Content of 41 wt %) | | | | | | | | 100 |
| EP Rubber | | | | | 60 | 70 | | |
| Flame Retardant | 55 | 55 | 55 | 55 | 55 | 55 | 55 | 55 |
| Antioxidant | 25 | 25 | 25 | 25 | 25 | 25 | 25 | 25 |
| Lubricant | 1.5 | 1.5 | 1.5 | 1.5 | 1.5 | 1.5 | 1.5 | 1.5 |
| Cross-linking Auxiliary Agent | 3 | 3 | 3 | 3 | 3 | 3 | 3 | 3 |
| Total | 184.5 | 184.5 | 184.5 | 184.5 | 184.5 | 184.5 | 184.5 | 184.5 |
| Secant Modulus (MPa) | 15 | 40 | 50 | 48 | 13 | 10 | 81 | 5 |

The electric cable of the invention can be configured as a halogen-free cable or a non-halogen-free cable. For the halogen-free cable, a metal hydroxide (a magnesium hydroxide etc.), a nitrogen flame-retardant substance, an antimony trioxide, a phosphorus flame retardant (red phosphorus, phosphoric ester), etc. can be used as a flame-retardant material, and for the non-halogen-free cable, a bromine flame retardant can be used.

Table 2 shows a comparative example and one example of the electric cable according to the invention, and shows flexibility (bending rigidity) of the electric cable (shielded electric wire) made of the resin material of Composition Example shown in Table 1 as the resin materials of the insulator 12 and the sheath 14 in the electric cable. The cross-sectional area of a conductor is 20 SQ (20 $mm^2$) or more, and a diameter of each wire constituting the conductor, a thickness of the insulator 12 and a thickness of the sheath 14 are respectively changed.

In Table 2, the upper stage of a braid configuration shows the number of counts, and the lower stage shows the number of holdings. The conductors of Examples 1 to 6, Example 8 and Comparative Example have role-lay-stranded structures, and a value of the upper stage of Table is the number of member strands, and a numerical value of the lower stage of Table is the number of wires included in each member strand.

Table 2 evaluates a bending rigidity of the electric cable which includes at least a conductor being made of wires a diameter of each of which is from 0.15 to 0.5 mm and having a cross-sectional area of 20 $mm^2$ or more, and an insulating resin including a flame retardant and covering an outer periphery of its conductor, and which is formed such that a ratio of an insulator outside diameter to a conductor diameter is from 1.15 to 1.40.

TABLE 2

| | | | Example 1 | Example 2 | Example 3 | Example 4 | Example 5 | Example 6 | Example 7 | Example 8 | Comparative Example |
|---|---|---|---|---|---|---|---|---|---|---|---|
| Size | | SQ | 20 | 50 | 20 | 50 | 35 | 70 | 50 | 40 | 40 |
| Conductor | Configuration | Number | 19 | 19 | 19 | 37 | 12 | 19 | 1 | 19 | 19 |
| | | Number | 13 | 32 | 42 | 54 | 23 | 19 | 798 | 80 | 80 |
| | Strand Diameter | mm | 0.32 | 0.32 | 0.18 | 0.18 | 0.4 | 0.5 | 0.282 | 0.18 | 0.18 |
| | Outside Diameter | mm | 6.5 | 10.1 | 6.5 | 10.2 | 9 | 12.1 | 9.78 | 9 | 9 |
| Insulation | Thickness | mm | 1.3 | 1.6 | 1.1 | 1.6 | 0.8 | 0.9 | 1.01 | 1.4 | 1.4 |
| | Outside Diameter | mm | 9.1 | 13.3 | 8.7 | 13.4 | 10.6 | 13.9 | 11.8 | 11.8 | 11.8 |
| Braid | Configuration | Number | 24 | 24 | 24 | 24 | 24 | 24 | 24 | 24 | 24 |
| | | Number | 8 | 10 | 8 | 10 | 12 | 13 | 13 | 10 | 10 |
| | Strand Diameter | mm | 0.18 | 0.18 | 0.18 | 0.18 | 0.16 | 0.18 | 0.16 | 0.18 | 0.18 |
| Sheath | Thickness | mm | 1 | 1.5 | 1 | 1.5 | 0.8 | 1.1 | 0.76 | 1.5 | 1.5 |
| | Outside Diameter | mm | 11.5 | 17.2 | 11.5 | 17.2 | 12.7 | 17 | 13.97 | 15.6 | 15.6 |
| Insulation Outside Diameter to Conductor Outside Diameter | | | 1.40 | 1.32 | 1.34 | 1.31 | 1.18 | 1.15 | 1.21 | 1.31 | 1.31 |

TABLE 2-continued

| | | Example 1 | Example 2 | Example 3 | Example 4 | Example 5 | Example 6 | Example 7 | Example 8 | Comparative Example |
|---|---|---|---|---|---|---|---|---|---|---|
| Sheath Outside Diameter to Conductor Outside Diameter | | 1.77 | 1.70 | 1.77 | 1.69 | 1.41 | 1.40 | 1.43 | 1.73 | 1.73 |
| Composition of Insulation and Sheath | | Composition Example 6 | Composition Example 5 | Composition Example 4 | Composition Example 2 | Composition Example 3 | Composition Example 1 | Composition Example 2 | Composition Example 2 | Composition Example 7 |
| Bending Rigidity | $10^3$N · mm | 70 | 286 | 116 | 550 | 253 | 564 | 251 | 363 | 701 |
| Cross-sectional Area of Electric Wire | $mm^2$ | 103.82 | 232.23 | 103.82 | 232.23 | 126.61 | 226.87 | 153.2 | 191.04 | 191.04 |
| Bending Rigidity to Cross-sectional Area of Electric Wire | $10^3$N | 0.68 | 1.23 | 1.11 | 2.37 | 2.00 | 2.49 | 1.64 | 1.90 | 3.67 |

Figure 2:
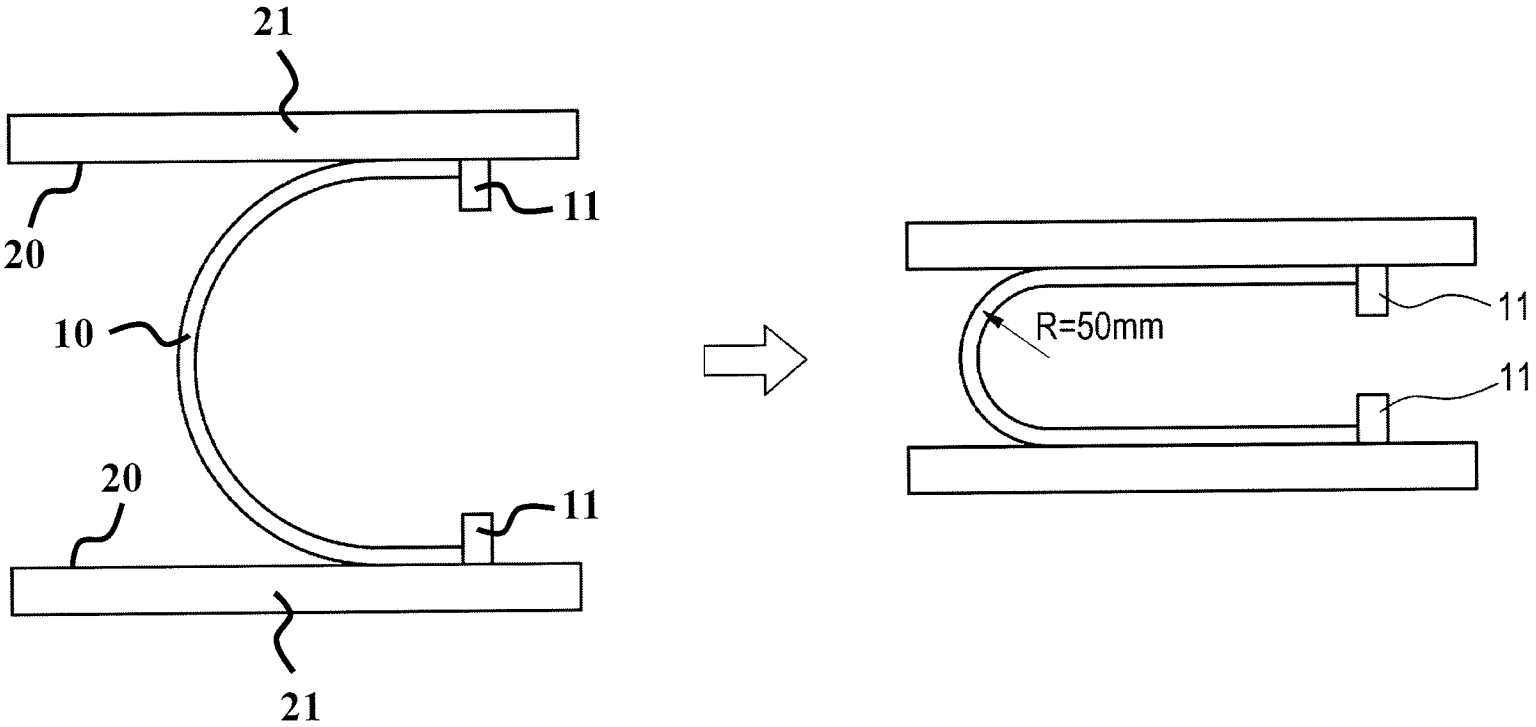
[FIG. 2] A diagram showing a method for measuring flexibility of a cable.

Flexibility of the cable is determined by, for example, a method as shown in FIG. 2 in conformity with IEC60794-1-2 Method17C. A cable 10 is placed between a fixed surface 20 and a plate 21 arranged in parallel with its fixed surface 20 and is bent 180°, and the end of the cable 10 is fixed to the fixed surface. The end of the cable 10 is fixed by a fixing member 11 formed on the fixed surface. A load cell is placed on the plate, and a weight at the time of being bent until a bending radius reaches 50 mm is measured to obtain a bending rigidity ($N \cdot mm^2$). A test is performed at room temperature. For cables of Examples 1 to 8 and Comparative Example, it is evaluated that the cable is flexible when each measured bending rigidity is less than or equal to a value of the bending rigidity every size (a cross-sectional area SQ of a conductor) shown in Table 3. For example, it is evaluated that the cable is flexible when the bending rigidity is less than or equal to $365 \times 10^3$ $N \cdot mm^2$ for the cross-sectional area of 40 SQ (40 $mm^2$). The cable with a smaller cross-sectional area of the conductor is often bent and used with a smaller curvature, and requires greater flexibility. With the experimental values of Table 3, the shielded electric wire as shown in FIG. 1B will have flexibility sufficient to facilitate bending and stretching work. The values of Table 4 are for providing the insulated electric wire as shown in FIG. 1A with flexibility sufficient to facilitate bending and stretching work, and the bending rigidities of the insulated electric wires of the invention will be less than or equal to these values.

TABLE 3

| Case of Shielded Electric Wire | | | | | |
|---|---|---|---|---|---|
| SQ ($mm^2$) | 20 | 30 | 40 | 50 | 70 |
| Bending Rigidity ($10^3$N · $mm^2$) | 155 | 260 | 365 | 620 | 780 |

TABLE 4

| Case of Insulated Electric Wire | | | | | |
|---|---|---|---|---|---|
| SQ ($mm^2$) | 20 | 30 | 40 | 50 | 70 |
| Bending Rigidity ($10^3$N · $mm^2$) | 80 | 130 | 155 | 310 | 365 |

Examples 1 to 8 and Comparative Example shown in Table 2 show the example in which the bending rigidities of various cables with sizes (cross-sectional areas) from 20 to 70 SQ are measured using insulating materials of Composition Examples 1 to 7 as composition of insulators and sheaths. In all Examples, the bending rigidities were less than or equal to the values shown in Table 3, and flexibility was good. The secant moduli of the insulating materials of Composition Examples 1 to 6 were 10 to 50 MPa. However, in the case of Comparative Example in which the insulating material of the cable of Example 8 is changed from Composition Example 2 to Composition Example 7, the bending rigidity became high ($701 \times 10^3$ $N \cdot mm^2$) and was more than the value ($365 \times 10^3$ $N \cdot mm^2$) of 40 SQ shown in Table 3, and flexibility was bad.

As described above, in the electric cable with the cross-sectional area of 20 SQ (20 $mm^2$) or more, the cable with good flexibility can be obtained when the insulating material with the secant modulus of 10 to 50 MPa is used in at least one of the inside and the outside of the shielding conductor. Cross-linking or a change in a comonomer content of the base resin can change the secant modulus of the insulating material, and when the insulating resin is an olefin resin including a comonomer having polarity, the resin with the secant modulus of 50 MPa can be obtained without mixing a rubber component into the base resin when an amount of the comonomer is 23% or more by weight.

Based on the result of Table 2, according to a ratio of an insulator outside diameter to a conductor outside diameter, as to the electric cable which includes the conductor being made of wires a diameter of each of which is from 0.15 to 0.5 mm and having a cross-sectional area of 20 $mm^2$ or more and the insulating resin including the flame retardant and covering an outer periphery of the conductor and which is formed such that a ratio of a diameter of the electric cable to a diameter of the conductor from 1.15 to 1.40, it is considered that good flexibility can be obtained by setting the secant modulus of the insulating resin from 10 to 50 MPa.

While the invention has been described in detail with reference to the embodiment, it is apparent to the skilled person that various changes or modifications can be made without departing from the spirit and scope of the invention.

INDUSTRIAL APPLICABILITY

An electric cable of the invention can ensure unprecedented flexibility, and facilitates wiring work (routing) inside small space, and can achieve a saving in space by, for example, decreasing a bending radius.

DESCRIPTION OF REFERENCE NUMERALS AND SIGNS

10*a* . . . INSULATED ELECTRIC WIRE
10*b* . . . SHIELDED ELECTRIC WIRE
11 . . . CENTRAL CONDUCTOR (CONDUCTOR)
12,12' . . . INSULATOR
13 . . . SHIELDING CONDUCTOR
14 . . . SHEATH
20 . . . FIXED SURFACE
21 . . . PLATE
22 . . . LOAD CELL

The invention claimed is:

1. An electric cable, including:

a conductor being made of wires a diameter of each of which is from 0.15 to 0.5 mm and having a cross-sectional area of 20 $mm^2$ or more; and an insulating resin including a flame retardant and covering an outer periphery of the conductor, wherein the insulating resin includes one or more resins selected from a group consisting of an ethylene-ethyl acrylate copolymer (EEA), an ethylene-vinyl acetate copolymer (EVA), an ethylene-methyl acrylate copolymer (EMA), and an EP rubber, wherein a ratio of a diameter of the electric cable to a diameter of the conductor is from 1.15 to 1.40, and wherein the insulating resin is cross-linked, and has a secant modulus of 10 to 50 MPa.

2. The electric cable of claim 1, wherein the insulating resin with the secant modulus of 10 to 50 MPa is a copolymer A consisting of a comonomer having polarity and olefin, or a mixture of the copolymer A and a copolymer B consisting of α-olefin and olefin.

3. The electric cable of claim 1, wherein the insulating resin with the secant modulus of 10 to 50 MPa is an olefin resin including a comonomer having polarity, and an amount of the comonomer is 23% or more by weight.

4. An electric cable, including:

a conductor having a cross-sectional area of 20 $mm^2$ or more; and an inside insulating resin including a flame retardant and covering the conductor;

a shielding conductor covering an outer periphery of the inside insulating resin; and an outside insulating resin covering an outer periphery of the shielding conductor, wherein each of the inside insulatin resin and the outside insulatin resin includes one or more resins selected from the group consisting ethylene-ethyl acrylate copolymer (EEA), an ethylene-vinyl acetate copolymer (EVA), an ethylene-methyl acrylate copolymer (EMA), and an EP rubber, wherein a ratio of a diameter of the electric cable to a diameter of the conductor is from 1.40 to 1.77, and wherein at least one of the inside insulating resin and the outside insulatin resin is cross-linked, and has a secant modulus of 10 to 50 MPa.

5. The electric cable of claim 4, wherein the inside insulating resin and the outside insulating resin are made of a same resin.

* * * * *